United States Patent [19]

Patricy

[11] Patent Number: 4,878,274

[45] Date of Patent: Nov. 7, 1989

[54] SECUREMENT SYSTEM

[76] Inventor: Henry R. Patricy, 2640 Lost Nation Rd., Willoughby, Ohio 44094

[21] Appl. No.: 218,673

[22] Filed: Jul. 13, 1988

[51] Int. Cl.[4] ..... A44B 18/00; A61B 17/12

[52] U.S. Cl. ..... 24/306; 24/450; 128/327

[58] Field of Search ..... 24/306, 300, 442, 450, 24/451, 17 AP; 128/327, DIG. 15; 2/DIG. 6

[56] References Cited

U.S. PATENT DOCUMENTS

| | | | |
|---|---|---|---|
| 2,805,058 | 9/1957 | Grant | 267/69 |
| 3,086,529 | 4/1963 | Munz et al. | 2/DIG. 6 |
| 3,372,438 | 3/1968 | Rinecker | 24/450 |
| 3,543,977 | 12/1970 | Lockridge | 128/DIG. 15 |
| 3,827,107 | 8/1974 | Moore | 128/DIG. 15 |
| 3,947,927 | 4/1976 | Rosenthal | 128/DIG. 15 |
| 4,149,540 | 4/1979 | Hasslinger | 128/DIG. 15 |
| 4,273,130 | 6/1981 | Simpson | 2/DIG. 6 |
| 4,291,439 | 9/1981 | Riti | 24/306 |
| 4,591,148 | 5/1986 | Slater | 24/306 |
| 4,672,722 | 6/1987 | Malamed | 24/450 |

*Primary Examiner*—Victor N. Sakran

*Attorney, Agent, or Firm*—Watts, Hoffmann, Fisher & Heinke Co.

[57] ABSTRACT

A securement system of the type for mounting an object, such as a hammock, snow skis or the like to a support member or to one another including an elongated flexible body member having inner and outer sections. The inner section including a portion made from a polymeric fabric material and a frictional gripping member made from a rubber material having angularly disposed corrugations adapted for frictional gripping engagement with the support member, and the outer section including Velcro mating portions to provide a coupling for holding the body member in a closed condition.

7 Claims, 2 Drawing Sheets

SECUREMENT SYSTEM

TECHNICAL FIELD

This invention relates to fastening systems, and more particularly relates to a new and novel securement system for securing and/or supporting various items together such as in the securement of a hammock or the like to a support member. It will be recognized, however, that in the invention the securement system may be applied for securing and/or supporting various items, as desired.

BACKGROUND OF THE INVENTION

The present invention relates to a new and novel securement system for securing and/or supporting various types of products. Heretofore, various types of fastening systems including those which are known as Velcro systems for securing or attaching one component part to another component part or for hanging or supporting various objects, such as tools or the like to a supporting rack. These prior Velcro-type systems have generally included male and female fiber-type members that are brought into inter-locking engagement with one another to provide the securement. Over the years, the primary focus for these Velcro-type systems has been in the design of the particular structure of the fiber or filaments that comprise the components that engagably mesh with one another to provide the securement.

The present invention incorporates, as a part of the novel system, the Velcro components but in the configuration of a flexible, locking strap member of a specific design so as to maximize the strength and locking characteristics of the strapping system for engagement with various size component parts to be secured.

SUMMARY OF THE INVENTION

In the present invention, there is provided a new and novel securement system embodied in the form of an elongated, flexible strapping member having one or more female locking ring elements at one end and a male pilot element at the other end to facilitate threading of the strapping member through the locking ring elements. In the invention, the strapping member is of a composite construction having a base layer made from a cloth-fiber material that interconnects the locking ring and pilot elements, and with an elastomeric member secured to the inner side of the base member and with male and female Velcro members secured to the exterior side of the base member whereby the inner elastomeric gripping member frictionally engages one component part to be secured with the male and female Velcro members being adapted to be brought into interlocking engagement upon looping of the strap member through and around at least one of the locking ring elements for securement of another component part.

It will be seen that the present invention provides a flexible, light-weight securement system that can be readily produced at a relatively reduced cost yet which is of a rugged construction that provides a positive securement between component parts. The system of the invention lends itself to being quickly and easily assembled and dis-assembled with minimum time and effort. Also, it will be recognized that in the invention the strapping system can be made in various sizes and/or configurations to accommodate a wide number of applications, as desired.

Other and further advantages and objects of the present invention will become apparent as the following description proceeds when taken in conjunction with the specifications and annexed drawings.

BRIEF DESCRIPTION OF THE DRAWINGS

FIG. 5 is a vertical section view illustrating the securement device of the present invention disposed around a support member such as a rod or pole of the type for supporting a hammock or the like.

DESCRIPTION OF THE PREFERRED EMBODIMENTS

Figure 1:
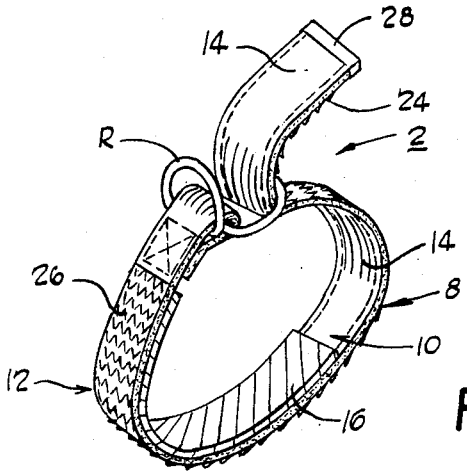
FIG. 1 is a generally perspective view of the securement device made in accordance with the present invention.
Figure 2:
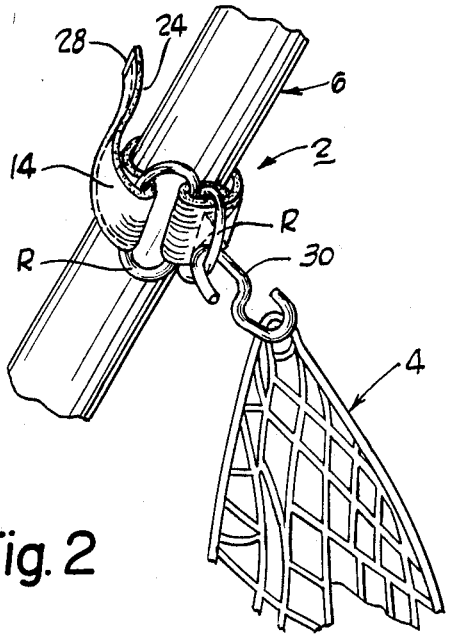
FIG. 2 is a fragmentary, generally perspective view illustrating one application of the securement device illustrated in FIG. 1 for mounting a hammock on a support rod or pole.
Figure 6:
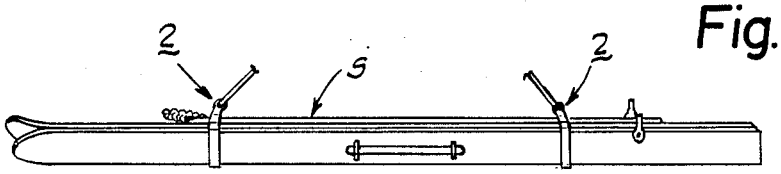
FIG. 6 is an elevation view illustrating another application of the securement device of the present invention for securing a pair of snow skis.
Figure 3:
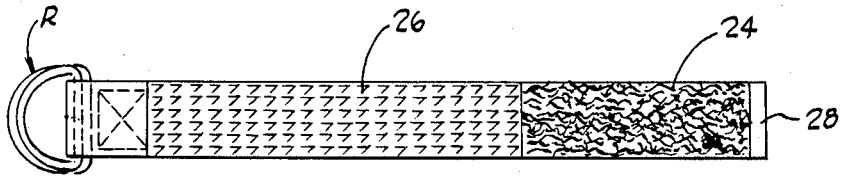
FIG. 3 is a top plan view of the securement device made in accordance with the present invention.

Referring again to the drawings and in particular to FIGS. 1 and 2 thereof, there is illustrated the securement device of the invention, designated generally at 2, for mounting a hammock or the like by means of a support member 6 such as a rod, pole or the like. Accordingly, in the invention it will be seen that the securement device 2 may be utilized for various types of fastening in securement applications such as in the securement of a pair of snow skis as best illustrated in FIG. 6. Moreover, the securement device 2 of the invention may be of any predetermined length and/or width as may be required for a particular securement application.

Figure 4:
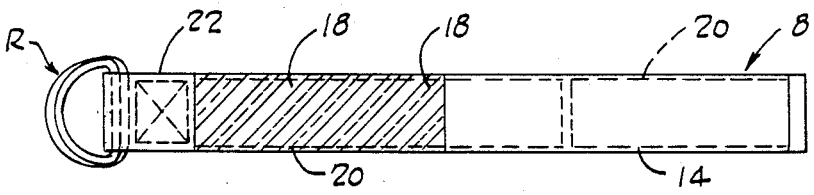
FIG. 4 is a bottom plan view of the securement device illustrated in FIG. 3.

In the embodiment illustrated, the securement device includes an elongated (e.g. rectangular) body member 8 which is flexible and of a predetermined length for particular application, as aforesaid. The body member 8 includes an inner section 10 and an outer section 12 which provide, in effect, a laminated construction. The inner section 10 includes a fabric portion 14 that may be made from a nylon material or the like, and an elastomeric gripping portion 16. The elastomeric portion is preferably made from a corrugated rubber material with the corrugations 18 extending at a 45° angle, as best illustrated in FIG. 4. However, it is recognized that the corrugations 18 may extend parallel to one another and parallel to the longitudinal axis of the body member 8, as desired. The elastomeric section is attached to an underlayment of the nylon material 14 by means of a heavy-duty stitching 20, as illustrated in FIG. 4. It will be seen that the elastomeric section 16 terminates inwardly of the opposite end of the body member 8 such that a pair of metal or plastic D-rings may be attached by looping the free end of the nylon material 14 through and around the respective linear portions of the D-rings, as at 22, so as to define a flap that, in turn, is stitched in overlying relation to the nylon underlayment material. Accordingly, on the inner section 10 the elastomeric material 16 extends from approximately the mid-point of the body member 8 and terminates longitudinally inwardly of the D-rings, designated generally at R. The rings R may be D-shaped or rectangular in shape or a combination thereof to provide securement of the belt clip 28.

On the outer section of the body member 8 there is provided a Velcro-type fastening system including a female portion 24 and a male portion 26, and with the female portion 24 having a belt clip 28 made from a metal or plastic material secured thereto to facility ingress and egress of the free end of the body member relative to the D-rings R. Here again, the female portion 26 of the Velcro system may terminate slightly inwardly of the D-rings to enable securement of the rings by means of the flap portion 22.

Figure 5:
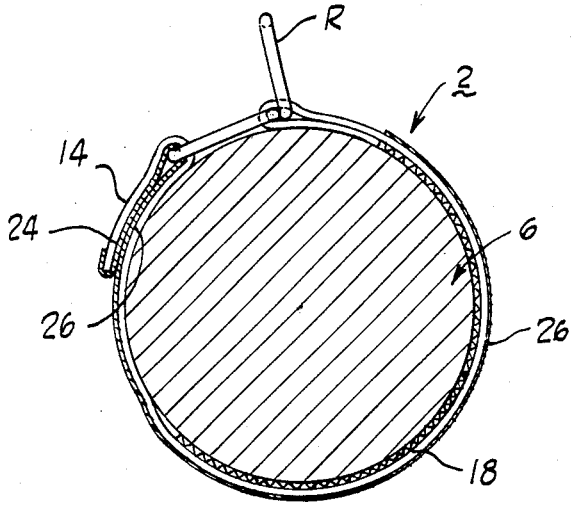

Accordingly, as illustrated in FIGS. 2 and 5, the securement device 2 is mounted around the support pole or rod 6 simply by inserting the belt clip 28 through one of the D-rings so as to bring the female portion 24 of the Velcro system into interlocking meshing engagement with the male portion 26 thereby to draw the elastomeric section 18 into tight gripping engagement around the confronting surface of the pole or rod 6. This provides a quick and positive securement for mounting an object such as a hammock or the like to a support member. As best illustrated in FIG. 2, the hammock 4 may be attached to one of the D-rings by means of an S-retainer clip, as at 30. Moreover, the securement clip can be easily removed simply by gripping the free end of the securement device and pulling it free of the Velcro securement thereby obviating the need for ancillary fasteners such as bolts, screws or the like for attaching the hammock to a support member.

Other advantages and objects of the present invention will become apparent and are contemplated within the appended claims.

I claim:

1. A securement device of the type adapted for mounting an object, such as a hammock, snow skis or the like to a support member or to one another, said securement device including a generally flexible, elongated body member having a predetermined length, said body member having inner and outer sections that are joined together by stitching, said inner section being made from a relatively elastic fabric polymeric material and further including a frictional gripping member, said friction gripping member being made from a rubber material having corrugations adapted for frictional gripping engagement with a support member, said outer section further including a female Velcro portion and a male Velcro portion to provide a frictional coupling upon contact with one another for holding said securement device in a closed configurations, one end of the body member having a retaining ring element adapted for receiving the opposite end of said body member such that the free end of the body member can be inserted through a looped around said ring element and secured in place by frictionally pressing the male and female portions of said Velcro system into engagement with one another.

2. A securement system in accordance with claim 1, wherein said corrugations extend at an angle of approximately 45° relative to the longitudinal central axis of said body member.

3. A securement system in accordance with claim 1, wherein said corrugations extend generally parallel to one another, and parallel to the longitudinal central axis of said body member.

4. A securement system in accordance with claim 1, wherein said rubber material is secured by stitching to said fabric material.

5. A securement system in accordance with claim 4, wherein said fabric material is made from nylon and extends throughout the length of said body member, and said male and female Velcro portions being secured to said nylon material.

6. A securement system in accordance with claim 1, wherein said elastomeric material is made from a rubber material and extends from generally the mid-point of said body member in a direction toward said retainer ring element, and said rubber material is stitched to said fabric material.

7. A securement system of type adapted for mounting an object, such as a hammock, snow skis or the like to a support member or to one another, said securement device including a flexible, elongated body member having a predetermined length, said body member having an inner section and an outer section, said inner section being made from a nylon fabric material and having a stitched thereto a frictional gripping member made of a rubber material and, said fabric material being relatively inelastic compared to said rubber material, said frictional gripping member having corrugations which extend parallel to one another and at an acute angle relative to the longitudinal central axis of said body member, said outer section including female Velcro portion and a male Velcro portion adapted for coupling engagement with one another upon a contact thereof, a one end of said body member mounting a retainer ring element adapted for receiving the opposite end of said body member such that the free end of said body member can be inserted through and looped around said ring element and secured in place by frictionally pressing the male and female portions of said Velcro portions into engagement with one another.

* * * * *